United States Patent [19]

Contreras

[11] 4,042,982

[45] Aug. 23, 1977

[54] FLUSH TOILET WATER CONSERVATION VALVE ASSEMBLY

[76] Inventor: Albert Contreras, 2230 Prospect St., National City, Calif. 92050

[21] Appl. No.: 748,119

[22] Filed: Dec. 6, 1976

[51] Int. Cl.[2] ..... E03D 1/34; E03D 5/02; A61B 19/00

[52] U.S. Cl. ..... 4/67 A; 4/67 R; 4/34; 4/57 P

[58] Field of Search ..... 4/67 A, 67 R, 57 R, 4/57 P, 34, 52

[56] References Cited

U.S. PATENT DOCUMENTS

| | | | |
|---|---|---|---|
| 3,375,531 | 4/1968 | Lake | 4/57 P |
| 3,766,571 | 10/1973 | Elder et al. | 4/67 A |
| 3,768,103 | 10/1973 | Robinson | 4/67 A |
| 3,795,016 | 3/1974 | Eastman | 4/67 A |
| 3,903,551 | 9/1975 | Johnson | 4/67 A |
| 3,909,856 | 10/1975 | Dunn, Jr. | 4/67 A |
| 3,913,149 | 10/1975 | Brinton | 4/67 A |
| 3,918,105 | 11/1975 | Young | 4/67 A |
| 4,011,604 | 3/1977 | Goldsworthy | 4/34 |

*Primary Examiner*—Henry K. Artis
*Attorney, Agent, or Firm*—Brown & Martin

[57] ABSTRACT

A flush toilet water valve assembly for connection to a water closet that has first and second open ended conduits that are selectively opened by valve mechanism to discharge water from different levels, and thus different water volumes, from the water closet to the toilet bowl. The first and second conduits intersect adjacent the lower end connection of the flush valve body to the discharge opening of the water closet. A valve mechanism within the valve assembly selectively closes off water passage through one or the other of the conduits in response to flush flow through the other conduit, preventing cross flow of water from one conduit through the other conduit.

9 Claims, 5 Drawing Figures

FLUSH TOILET WATER CONSERVATION VALVE ASSEMBLY

BACKGROUND OF THE INVENTION

The use of flush water in flushing toilet systems, is known to be large. The need to conserve water consumption now requires recognition that large amounts of water can be conserved by providing a dual level flush valve system in water closets. In such systems, the amount of flush water passed into the flush bowl from the water closet can be selectively varied, depending upon the amount and type of waste to be removed from the toilet bowl.

There are several known systems that provide dual level flushing from water closets to toilet bowls. Examples of such systems are in the J. Martino U.S. Pat. Nos. 2,839,759 and 2,864,095, the Easley U.S. Pat. No. 2,237,294, the Lake U.S. Pat. No. 3,375,531, the White U.S. Pat. No. 3,869,733 and the Robinson U.S. Pat. No. 3,768,103. While these patents disclose double pump valve discharge assemblies, they do not disclose valve systems that are capable of being used effectively, inexpensively and with reliable operation, and that uses accepted parts in the industry for flush valve assemblies. Further, the valve systems do not provide for water flow interface between the two valves, which reduces the effectiveness of the overall system when the flush valve assembly is in the lower water volume discharge mode.

Thus, it is advantageous to have a new and improved flush toilet water conservation valve assembly that corrects the water flow problems between two separate valve controlled discharges and also provides a valve assembly that has a design and a construction and uses parts such that it is more likely to be commercially used.

SUMMARY OF THE INVENTION

In a preferred embodiment of the flush toilet water conservation valve assembly, a flush valve body has a lower end connector for connection to the central lower discharge opening of existing flush tanks that are used in known water closet type toilet bowl flushing systems.

The flush valve body has upwardly directed first and second, open ended water conduits that have water flow passages to the lower discharge end of the flush valve body. These first and second open ended conduits are joined at their intersection adjacent the lower connector end or discharge end of the flush valve body. The open end of the first conduit expends upwardly a greater distance than the open end of the second conduit, thus providing a two level flush by the flush valve, depending upon which conduit is open. The flush valve elements closing the open ends of the conduits are separately controlled by a flush valve operation mechanism. The flush valves elements are standard flush valves that are well known and accepted in the industry.

A separate flapper valve means is provided within the flush valve body at the intersection of the first and second conduits. This flapper type valve is pivotally connected in a manner that when one of the conduits is open for fluid discharge to the toilet bowl, then the valve is automatically moved to close off water flow back through the other conduit. This prevents back flow of water from one conduit out through the other conduit, creating turbulence problems as well as a reduction in fluid flow. This is particularly a problem where the upper level conduit opening is opened.

In a preferred embodiment of the invention, the upper conduit has a flow director that swirls the water in its movement thus directing the water straight down through the first conduit and through the discharge end of the water closet to the toilet bowl. In other embodiments, the angular positioning of the first and second conduits at their intersection creates a fluid flow that directly contacts the internal flapper type valve, causing it to move to close off the other non-water conducting conduit.

The overflow device is connected to the flush valve body at a point adjacent the inner connection of the first and second conduits, and in a position that water flow through the overflow does not interfere with the operation of the flapper valve. Also the vertically projecting overflow tube is oriented such that it is correctly spaced to provide support for the conduit valves, so that commercially acceptable and available valves are easily positioned and mounted for correct operation relative to the conduits. In one embodiment, the overflow conduit is positioned directly in the middle of the center of the intersection of the first and second conduits in substantial alignment with the center of the opening in the water closet discharge end. In still another embodiment, the upper level of the open end of the first conduit may be selectively adjusted to adjust that water discharge as most prudently acceptable for given size water closets and given size toilet bowls and commodes.

It is therefore an object of this invention to provide a new and improved flush toilet water conservation valve assembly that employs the level discharge of water from the water closet to the commode.

It is another object of this invention to provide a new and improved flush toilet water conservation valve assembly that is capable of discharging two selected volumes of water to the toilet bowl, which valve assembly has a reliable operation and a relatively inexpensive and yet acceptable construction that uses known parts that are acceptable to the industry and that are easily replaceable, and comprises a flush toilet water valve assembly that is likely to be used and installed in existing water closets to afford meaningful and positive water conservation.

Other objects and many advantages of this invention will become more apparent upon a reading of the following detailed description and an examination of the drawings, wherein like reference numerals designate like parts throughout and in which.

Figure 1:
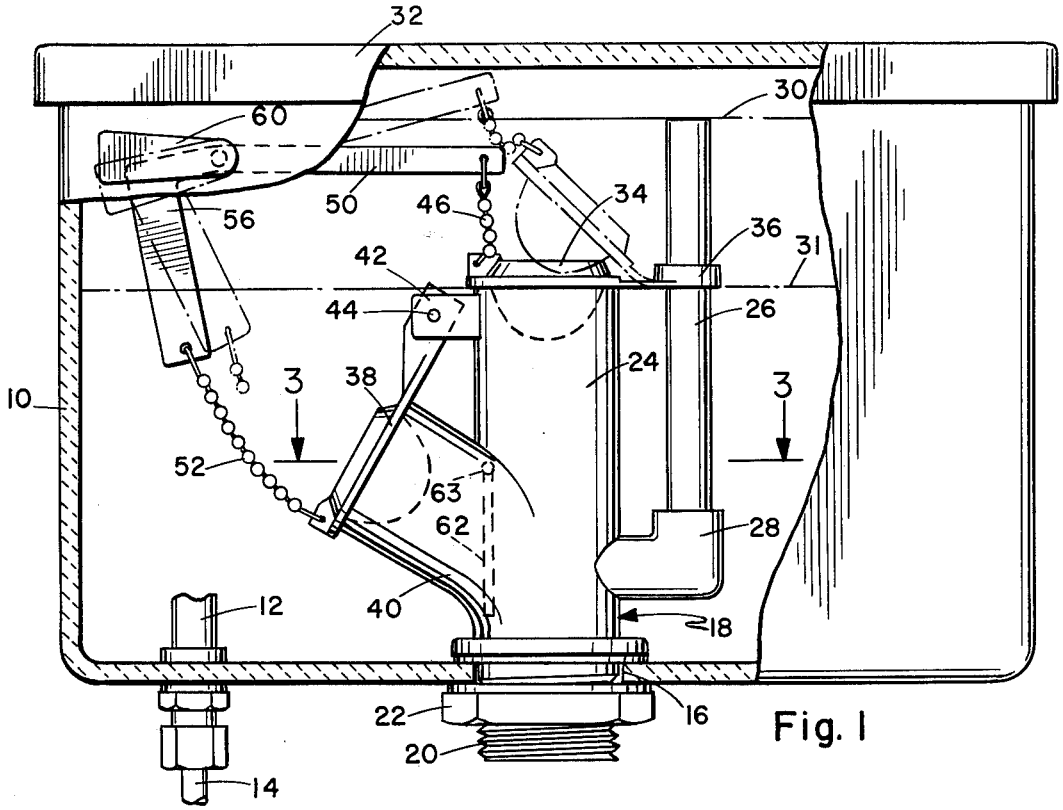
FIG. 1 is a side elevation view of a typical toilet flush tank, with portions cut away to illustrate the dual flush mechanism.
Figure 2:
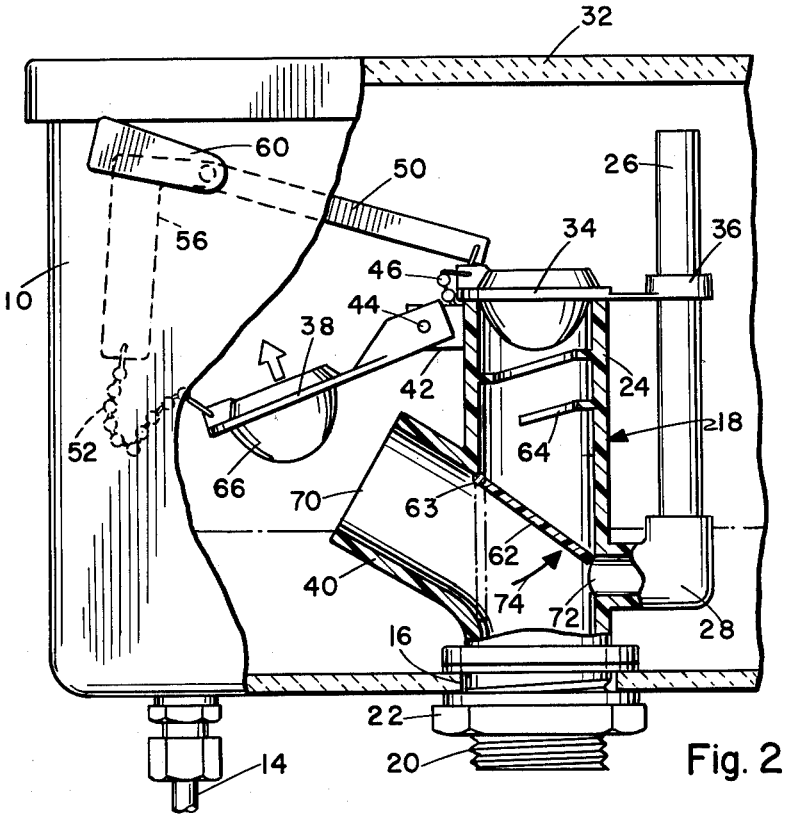
FIG. 2 is a similar view, further cut away, showing the full flush action.
Figure 3:
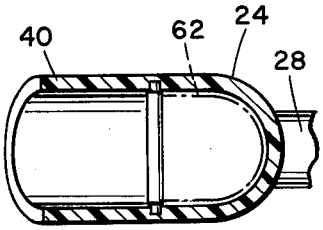
FIG. 3 is a sectional view taken on line 3—3 of FIG. 1.

Referring now to the drawings and to FIGS. 1, 2 and 3, a standard, known in the art water closet or toilet water tank 10 is illustrated, which may be mounted onto a commode or toilet bowl in the known manner. The water closet 10 is mounted over an opening in the water commode, with end 20 projecting through the opening in the commode and with a gasket or the like fitting around end 20 and against the underneath side of the nut 22, forming a seal for the passage of water from the water closet 10 into the commode (not shown). Water is supplied to the water closet 10 through a water line 14 and through an input line 12 that is connected to a known valve arrangement (not shown). In normal operation, the water level in the water closet 10 will assume that level determined by the float control or the valve control on line 12. This water level will normally be near the top of the water closet 10 and may rise as high as level 30, which would correspond to the upper opening of the overflow pipe 26.

The flush toilet water conservation valve assembly 18 comprises a flush valve body having a first upwardly positioned water conduit 24 and a second upwardly positioned water conduit 40. Each of these conduits have open upper ends that are selectively closed by flush valve elements 34 and 36. The first and second conduits are interconnected at the lower end of the flush valve body with intersecting flow channels. The lower end of the flush valve body projects through opening 16 in the bottom of the water closet 10 and is secured in position by connector members 22 to provide a sealed connection for the flow of water out of end 20 into the commode.

Flush valve elements 34 and 36 are respectively connected by chain linkages 46 and 52 to an operating lever having ends 50 and 56. The operating lever has an outside handle 60 that is pivotally rotated. Thus grasping the handle 60 and rotating it in a counter clockwise direction will raise end 50 of the lever, thus pulling flush valve 34 upwardly and opening conduit 24 to the flow of water which passes through the flush valve body 18 and through discharge end 20 into the commode. By turning handle 60 in the clockwise direction, end 50 pulls through linkage 56 and chain 52, flush valve 38 opens in a pivotal movement around its pivotal connection 44 on projecting ears 42. This opens conduit 40 to the passage of water into the flush valve body and out the discharge end 20. The ends 50 and 56 are balanced to provide substantially equal torque on the handle 60.

So movement of handle 60 alternatively and selectively opens water flow either through the first conduit 24 or the second conduit 40. In view of the level of the openings of the respective conduits, the amount of water entering conduit 24 is that determined by the lowering of the level of the water from 30 to 32, see FIG. 1. Thus, only this limited amount of water in the water closet 10 flows into the commode. Opening valve 38 drains water down to level 71, see FIG. 2, which is a substantially greater amount of water. Thus rotation of lever arm 60 in the counterclockwise direction passes a small amount of water in the commode and rotating arm 60 in the clockwise direction passes a larger amount of water into the commode.

The valve assembly 18 also has an internal flapper valve 62 that pivots around a pivotal connection 63. The flapper valve 62 in one position substantially closes off back water flow into the upper conduit 24 and in the second position closes off back water flow into the lower conduit 40. Also the first conduit 24 has an internal spiral shoulder 64 that provides a general swirling motion to the water as it passes through the first conduit and out the discharge end 20. The force of this movement of the water through the first conduit contacts flapper valve 62, pushing it to the position as illustrated in dotted lines in FIG. 1. This prevents water from flowing from the first conduit through the second conduit 40, opening valve 38 and allowing the water to flow out into the reservoir of the water closet 10. Also the opening of valve 38 causes water to move through opening 70 into the second conduit 40, where the water contacts flapper valve 62 moving it in the direction of arrow 74 to prevent back water flow up into the first conduit 24.

The overflow tube 26 is connected by connector 28 to discharge through opening 72. This discharge point is below the valve 62 in its upward position as illustrated in FIG. 2. The overflow tube 26 is so positioned that when the standard flush valve 34 is positioned on retainer 36 that fits around the tube 26, it is in correct position to provide sealing of the upper open end of the first conduit 24. Ears 42 are secured to the side of the flush valve structure to correctly position the ball 66 and thus flush valve 38 to seal opening 70 of the second conduit 40. While flapper valve 62 does not have a valve seat, as such, in the closed position there is sufficient sealing off of the respective conduit channels to prevent the reverse water flow.

Figure 4:
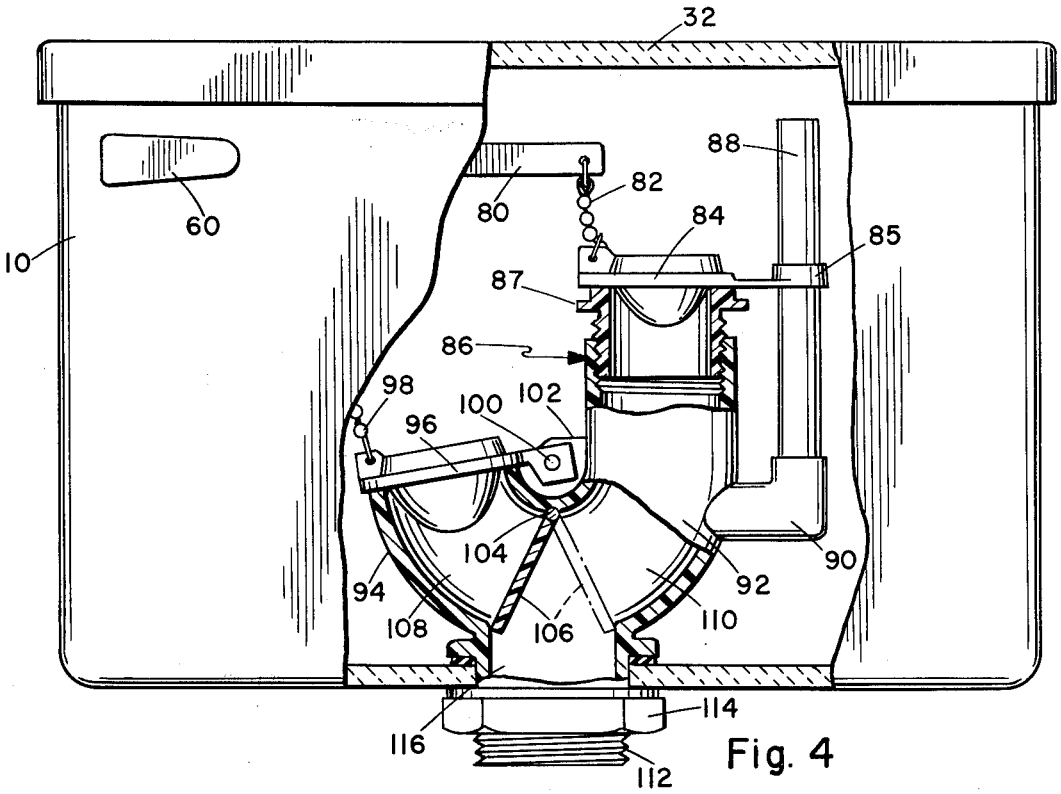
FIG. 4 is a view similar to FIG. 1, showing an alternative structure.

Referring now to FIG. 4, there is illustrated a modified embodiment of the invention, wherein the valve assembly 86 has a first conduit 92 and a second conduit 94 that are connected in a circular intersecting connection with the flapper valve 106 pivoted on pivotal connection 104 for movement as illustrated to close off selectively the volume 110 of the first conduit or volume 108 of the second conduit. In this embodiment, water passes into the first conduit by the opening of flush valve 84 by upward movement or arm 80 and chain 82 in response to counterclockwise rotation of lever arm 60. The water thus flows through conduit 92 and the volume 110 thereof, contacting flapper valve 106 and then passing through opening 116 and out the discharge end 112. The flush valve 96 is opened by chain 98 in pivotal movement around pivotal connection 100 to side projections 102 to selectively open water flow to pass through volume 108 to contact flapper valve 106 and then out the discharge end 112. The curved shape of the respective first and second conduits are such as to direct the water in a manner against flapper valve 106 to assure its correct positioning and valve closing action. The overflow line 88 and its connection 90 are positioned such that the water from overflow flows in the same movement as that of the water passing through the first conduit 92.

The upper open end of the first conduit 92 has a threaded sleeve 87 that may be selectively adjusted as to a desired height with the upper end having a valve seat for the flush valve element 84. The upper end of sleeve 87 may be selectively adjusted, as to height, to establish the amount of water that is passed into the commode by the opening of valve element 84. Valve element 84 maintains its respective valving position, by upward sliding movement of end 85 on the overflow tube 88.

Figure 5:
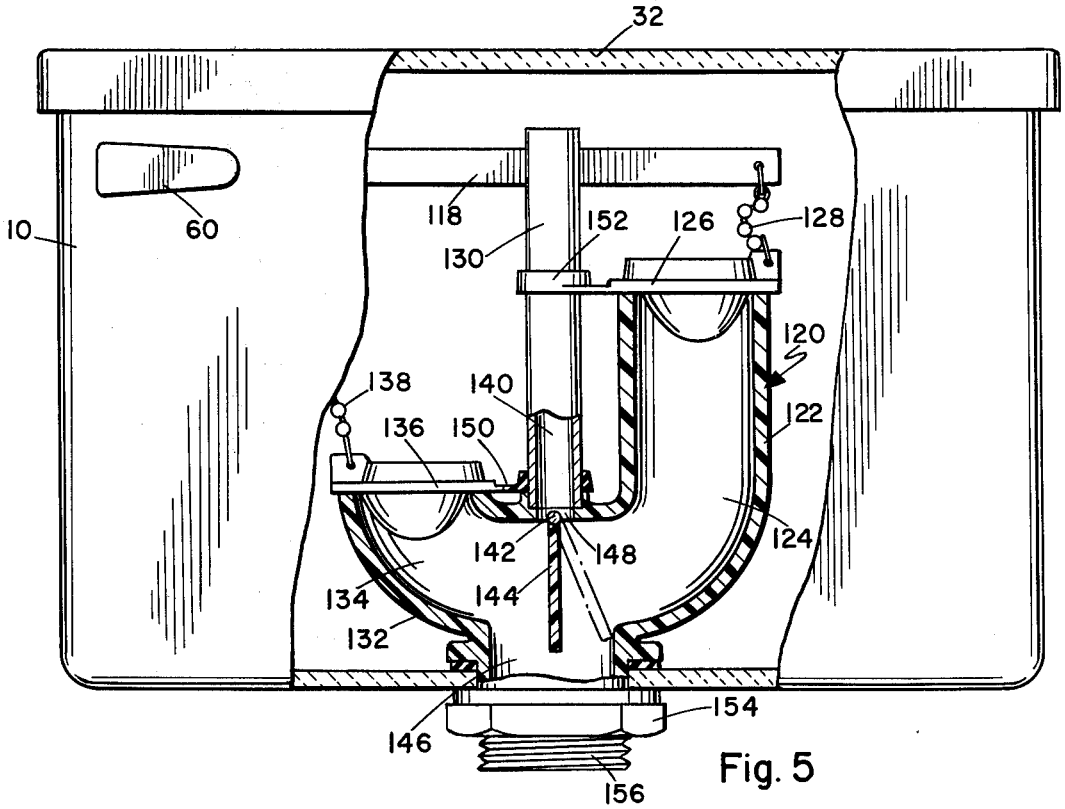
FIG. 5 is a similar view showing a further structure.

FIG. 5 illustrates still another embodiment which has the general circular shape as illustrated in FIG. 4, but wherein the overflow tube 88 is positioned directly over the center of the valve assembly 120 that is elongated along its mid-portion. The valve assembly operates in a similar manner to that previously described, wherein valve element 126 is held by ring end 152 and is moved upwardly by chain 128 that is raised by lever arm 118 upon counterclockwise rotation of arm 60. Valve element 136 on the second conduit 132 is raised upwardly by chain 138 around its connection 150 for allowing water to flow through volume 134 and out the discharge end 156. Also when water moves through the overflow valve 140, it comes directly down on either side of flapper valve 144 through volumes 140 and 148. Thus the flapper valve 144 maintains a central position on its pivot 142. This embodiment provides for standard flush valve elements 126 and 136 to be positioned on a centered overflow tube 130. Control of movement of the flapper valve 144 is as described relative to the embodiment of FIG. 4.

Having described my invention, I now claim:

1. A flush toilet water conservation valve assembly for being connected in a water closet of a water closet type toilet bowl flushing system, comprising:

a flush valve body having a lower discharge connector end for being connected to the discharge opening of the flush tank, said flush valve body having a first upwardly positioned water conduit and a second upwardly positioned water conduit, said first and second conduits being joined at an intersection adjacent the connector end of the flush body, said first conduit extending upwardly a greater distance than said second conduit, with each conduit having an open upper end, whereby a greater amount of flush water in the flush tank will flow into said first conduit than into said second conduit, a centrally positioned upwardly extending overflow pipe connected to said flush valve body at a point adjacent the intersection of said first and second conduits, first valve means selectively operable to open said first and second conduits at separate selective times, and second flapper valve means positioned in said first and second conduits at said intersection for selectively closing off reverse water flow from one of said conduits to the other of said conduits.

2. A flush toilet water conservation valve assembly as claimed in claim 1 wherein, said first conduit being substantially vertically oriented in operative position in the water closet, said second conduit extending from the side of said first conduit, and said first conduit having water flow directing means for spiraling water flow through said first conduit toward the lower discharge opening of said flush valve.

3. A flush toilet water conservation valve assembly as claimed in claim 2 wherein, said water flow directing means comprising an inner vertically displaced spiral portion fixed to the inner wall surface of said first conduit.

4. A flush toilet water conservation valve assembly as claimed in claim 2 wherein, said second conduit having an upper intersecting wall edge with the side of said first conduit, said second valve means comprising a flapper valve pivotally connected to said wall edge, and said second valve being pivotally moveable from a first position closing off said first conduit against reverse water flow and to a second position closing off said second conduit against reverse water flow.

5. A flush toilet water conservation valve assembly as claimed in claim 4 wherein, said overflow pipe having an opening connection to said flush valve body at the lower end of said flush valve body that is lower than the lower end of said flapper valve means when said flapper valve means is in either of the conduit closing positions.

6. A flush toilet water conservation valve assembly as claimed in claim 1 wherein, said lower ends of said first and second conduits curving to an arcuate intersection connection, said discharge end of said flush valve body having an opening at the midpoint of the lower wall at the intersection of said arcuate ends of said conduits, said second valve means comprising a second valve that is pivotally connected at the mid-point of the upper wall surface of said intersection of said first and second conduits, and said flapper valve projecting downwardly to close off the respective volumes of said first and second conduits in the first and second positions of said flapper valve.

7. A flush toilet water conservation valve assembly as claimed in claim 6 wherein, said first conduit having end means for selectively raising and lowering the height of the open end, said valve means comprising a first flush valve element for selectively opening and closing the open end of said first conduit and a second flush valve element for selectively opening and closing the open end of said second conduit, and means for selectively raising and lowering said first flush valve element upon raising and lowering said end means.

8. A flush toilet water conservation valve assembly as claimed in claim 7 wherein, said overflow pipe being positioned adjacent to the side of said first conduit, said flush valve element having a ring end connector on which the second valve portion pivots, and said ring end connector fitting slidably along the length of said overflow pipe to maintain correct valve element alignment of said valve element with the open end of said first conduit.

9. A flush toilet water conservation valve assembly as claimed in claim 6 wherein, said overflow pipe being vertically connected at its lower end to the upper surface of the inner section of said first and second conduits, said overflow pipe extending vertically therefrom and supporting the ends of said first and second flush valve elements, and the lower end of said overflow pipe projecting through the upper wall of said flush valve body at said intersection, projecting water on each side of said flapper valve, and maintaining said flapper valve in a non-closed position when water flows through said overflow pipe.

* * * * *